US007779964B2

(12) United States Patent
Birch et al.

(10) Patent No.: US 7,779,964 B2
(45) Date of Patent: Aug. 24, 2010

(54) ACOUSTIC ELEMENTS AND THEIR PRODUCTION

(75) Inventors: Jorgen Birch, Roskilde (DK); Gorm Rosenberg Jensen, Stenlille (DK); Lars Bollund, Slangerup (DK)

(73) Assignee: Rockwool International A/S, Hedehusene (DK)

( * ) Notice: Subject to any disclaimer, the term of this patent is extended or adjusted under 35 U.S.C. 154(b) by 658 days.

(21) Appl. No.: 11/547,012

(22) PCT Filed: Apr. 1, 2005

(86) PCT No.: PCT/EP2005/003438

§ 371 (c)(1),
(2), (4) Date: Feb. 16, 2007

(87) PCT Pub. No.: WO2005/095727

PCT Pub. Date: Oct. 13, 2005

(65) Prior Publication Data

US 2007/0272481 A1 Nov. 29, 2007

(30) Foreign Application Priority Data

Apr. 2, 2004 (EP) ..... 04252009

(51) Int. Cl.
*E04B 1/82* (2006.01)

(52) U.S. Cl. ..... 181/284; 181/286; 52/144; 52/145

(58) Field of Classification Search ..... 181/284, 181/286; 52/145
See application file for complete search history.

(56) References Cited

U.S. PATENT DOCUMENTS

| | | | | |
|---|---|---|---|---|
| 3,513,613 | A | 5/1970 | Jones et al. | |
| 3,513,631 | A | 5/1970 | Jones et al. | |
| 5,753,871 | A * | 5/1998 | Kahara et al. | 181/290 |
| 6,443,257 | B1 | 9/2002 | Wiker et al. | |
| 6,487,822 | B1 * | 12/2002 | Haack et al. | 52/144 |
| 2001/0005964 | A1 * | 7/2001 | Colson et al. | 52/506.06 |
| 2002/0134616 | A1 | 9/2002 | Sheperd et al. | |
| 2005/0090168 | A1 * | 4/2005 | Fay | 442/85 |
| 2008/0250729 | A1 * | 10/2008 | Kriesel | 52/145 |

FOREIGN PATENT DOCUMENTS

| | | |
|---|---|---|
| DE | 299 24 392 | 2/2003 |

(Continued)

*Primary Examiner*—Jeffrey Donels
*Assistant Examiner*—Forrest M Phillips
(74) *Attorney, Agent, or Firm*—Dickstein Shapiro LLP

(57) ABSTRACT

Acoustic element (1) has a flat, sound-receiving, front face (2) which extends in the XY plane and has a good sound-absorption coefficient, and the element is formed of a bonded batt of air laid mineral fibres having a density of 70 to 200 kg/m$^3$ wherein the fibres extend from the front face (2) and at least through the front half of the thickness of the batt have a Z direction component greater than the Z direction component of conventional air laid products, and the front face of the batt is a cut and abraded face. The element can be made by air laying mineral fibres and binder, reorienting the fibres to provide an increased fibre orientation in the Z direction, curing the binder to form a cured batt and cutting the cured batt in the XY plane into two cut batts and smoothing each cut surface by abrasion to produce a flat face on each cut batt.

21 Claims, 3 Drawing Sheets

FOREIGN PATENT DOCUMENTS

| | | |
|---|---|---|
| EP | 0 539 290 A1 | 4/1993 |
| EP | 12 288 12 | 8/2002 |
| EP | 1266991 | 12/2002 |
| WO | WO 92/10602 | 6/1992 |
| WO | WO 94/16162 | 7/1994 |
| WO | WO 95/20703 | 8/1995 |
| WO | WO 96/38391 | 12/1996 |
| WO | WO 97/36035 | 10/1997 |
| WO | WO 02/060597 A1 | 8/2002 |

* cited by examiner

ACOUSTIC ELEMENTS AND THEIR PRODUCTION

This invention relates to acoustic elements formed of airlaid mineral fibres.

Acoustic elements (often referred to as acoustic panels or acoustic tiles) have front and rear faces which extend in the XY plane and side edges which extend in the Z direction between the front and rear faces. The front face is the face which is to face towards the room or other space which is to benefit from the sound absorption properties and so this face should have a good sound absorption coefficient $\alpha_w$, generally of at least 0.7 and often more.

The visual appearance of a ceiling or wall formed from the acoustic elements tends to improve as the front face approaches a truly flat or planar face. On a scale where 1 represents the most planar and flat surface that is available in known elements made from mineral fibres, and 6 represents the lowest grade that would be considered to be commercially adequate for a low grade product, ratings of 1 or 2 are best and are generally required for high quality tiles while ratings of 3 or even 4 may be adequate for some purposes, especially where the visual appearance is not so critical.

The deviations from a truly flat or planar surface in fibrous products tend to be manifested by minor bulges. These can have a depth (from the valley to the peak) which is quite small, for instance below 0.3 mm, but light reflections can make them appear prominent and so it is desirable for the element to have a surface which is as flat as possible.

Acoustic elements can be made by casting wet or fluid materials (for instance they can be made from wet laid mineral fibres) but for many purposes it is preferred to form acoustic elements of airlaid mineral fibres.

A conventional way of making such products comprises forming a cured batt of fibres with a textile fleece bonded to each face and then cutting the batt in the XY plane into two halves. Each half has a cut face (which becomes the front face of the eventual element). Each front face is abraded to make it as flat as possible, and a textile is usually then bonded to it. Within this specification we use words such as "abrade", "abrasion" and "abrading" as being generic to processes for smoothing a rough surface, such as processes which are often known as grinding processes.

Products made by this technique generally have a density around 100 kg/m$^3$. They are adequate for many purposes but variations in the point to point quality of the batt which is cut, and the surface which is then abraded, can result in the front face bulging more than is required for some uses. Typically it has a grade of 3 or 4, although it can be better, e.g., 2 or 3, when made from some grades of glass wool.

In order to reduce this problem, it is known to form an airlaid batt and then subject it to carding so as to separate the batt into individual fibres and uncarded tufts or other debris (such as tufted agglomerates of binder and fibres), collect the individual fibres whilst rejecting uncarded debris, compress the collected individual fibres in the presence of binder to a high density, typically over 150 kg/m$^3$ (eg. around 190 kg/m$^3$) and cure the binder. Textile facing is usually applied to the front and rear faces before and after curing. Such a method is described in EP-A-539290.

As a result of forming the batt from carded fibres and rejecting the debris, the batt can have a satisfactorily flat front face, typically of grades 1 or 2. However the carding results in a weaker structure and so the density has to be high in order that the product has sufficient structural integrity. The increased density and the extra process steps increase the cost of the elements and may reduce the acoustic absorption properties.

Acoustic elements can be bonded direct to a wall or ceiling, but usually they are mounted on a grid, and in particular it is desirable to provide ceiling tiles that are suspended from a grid. The load therefore has to be borne by the edges of the tiles and so the tiles need adequate edge strength in addition to having an overall structure that has sufficient strength to avoid damage during handling.

It would be desirable to be able to make acoustic elements having good sound absorbing properties, a front face having improved flatness, and good and overall edge strength from airlaid mineral fibres by a process which is simpler than the carding process and to a density which can be less than the rather high values that are often required when using the carding process.

An acoustic element according to the present invention has a flat, sound receiving, front face which extends in the XY plane and which has a sound absorption coefficient $\alpha_w$ of at least 0.7, a rear face substantially parallel to the front face and side edges which extend in the Z direction between the front and rear faces, and the element consists predominantly of a bonded batt of airlaid mineral fibres having a density of 70 to 200 kg/m$^3$, and in this batt the fibres which form the front face and at least the front half of the thickness of the batt have a Z direction component substantially greater than the Z direction component of fibres in airlaid products made by collecting fibres entrained in air by suction through a travelling collector and vertically compressing the collected fibres, optionally after cross-lapping the collected fibres, and the front face of the bonded batt is a cut and abraded surface.

By the invention it is possible easily to provide elements of moderate density and having good acoustic properties (for instance $\alpha_w$ at least 0.8 or 0.85 and preferably above 0.9 or 0.95) and having a flat front face of improved flatness without having to card the airlaid fibres.

When mineral fibres are being airlaid, they are carried in entrained air to a collector and they are collected as a web by applying suction through the collector. The predominant orientations of the fibres are therefore in the XY plane, with the proportion in the X direction (i.e., the machine direction) increasing as the speed of the collector increases. If the resultant web is cross-lapped, this will increase the Y component but the predominant orientation will still be in the XY plane.

In the known processes where such a product, after curing, is cut in the XY plane, the fibres in and close to the cut face, and throughout the entire thickness of the element, will be predominantly oriented in substantially the same plane as the cut face, ie. in the XY plane. In addition to the individual fibres existing predominantly in the XY plane, defects such as tufts or other debris (for instance of over bonded or inadequately fiberised material) will also be oriented predominantly in the XY plane.

In the invention, however, the defects will have substantially the same increased component in the Z direction as the fibres and this, combined with the density of the product, has been found to result in a cut and abraded surface being substantially flatter than when the fibres (and defects) are still predominantly in the XY plane.

The novel acoustic elements are made by a process comprising collecting the mineral fibres entrained in air on a travelling collector and vertically compressing the collected fibres, optionally after cross-lapping, to form a web, reorienting the fibres to provide an unbonded batt having a density of 70 to 200 kg/m$^3$ and an increased fibre orientation in the Z direction, curing the binder to form a cured batt, cutting the cured batt in the XY plane into two cut batts at a position in the Z dimension wherein the fibres have the increased orientation in the Z direction, and smoothing each cut surface by abrasion to produce a flat smooth face.

The process also comprises the routine steps of forming elements having the desired XY dimensions by subdividing the cured batt before it is cut into the two cut batts and/or by subdividing the cut batts before or after abrasion, to form elements having the desired XY dimensions, and often bonding a facing tissue or other web onto either or both faces. The facing web is often a non-woven or other textile of the types typically used for facing acoustic elements.

The density of the unbonded batt and the cured batt is usually below 180 kg/m$^3$ and often it is not more than 150 or 160 kg/m$^3$. Densities of 140 kg/m$^3$ and below are often preferred.

Various processes are known for reorientating airlaid mineral fibres in a web so as to increase their orientation in the Z direction. One such process includes slicing the web into lamellae and turning the lamellae through 90° and reforming a web from the turned lamellae, for instance as described in WO 92/10602. In another method pleats extending in the Y direction (ie. transverse to the machine direction) are formed by reciprocating the web in the Z direction as it enters a confined space deeper than the thickness of the web, followed by compression to the desired density, usually by compression of the pleats by applying longitudinal compression to the pleated, confined, web. Such methods are described in WO 94/16162 and WO 95/020703.

These methods can be used but the preferred method of reorienting the fibres comprises forming an airlaid web having a density of at least 10 kg/m$^3$ and a weight per unit area of W and subjecting the web to longitudinal compression to form a longitudinally compressed web having a weight per unit area generally of at least 1.7 or 1.8 W and preferably at least 2 W. An alternative way of defining this degree of longitudinal compression is by defining it as a longitudinal compression ratio of 1.7 or 1.8:1 and preferably at least 2:1.

The initial web having a density of at least 10 kg/m$^3$ is usually formed by vertically compressing either the primary web formed by collecting fibres on to a collector or a secondary web formed by cross-lapping the primary web. The density of the web before longitudinal compression typically is at least 15 or 20 kg/m$^3$ and preferably from 25 to 50 kg/m$^3$, often 25 to 35 kg/m$^3$ and is generally from 15 to 50%, often 20 to 40%, of the final density of the cured batt. The density after the longitudinal compression is generally from 50 to 100%, often 70 to 90%, of the density of the cured batt.

The longitudinal compression is generally conducted while constraining the web against uncontrolled vertical expansion, and usually the longitudinal compression is conducted under conditions of substantially uniform thickness, i.e., substantially without vertical compression of vertical expansion, but some vertical compression or expansion can be applied during the longitudinal compression provided that it does not interfere with the required reorientation.

The weight per unit area of the longitudinally compressed web and of the cured batt is at least 1.7 or 1.8 W and preferably at least 2 W and often it is at least 2.2 or 2.3 W. Generally it is in the range 2.4 to 2.8 or 3 W, but it can be higher, for instance 3.5 W or 4 W.

In order to optimise the Z direction orientation, it is preferred to subject the vertically constrained web to greater longitudinal compression than is ultimately required and then to subject the web to longitudinal expansion (ie. decompression), so as to relax the web before curing. For instance the web may initially be compressed to a weight per unit area of, for instance, 0.2 to 1 W more than is ultimately required, and the web can then be longitudinally relaxed to achieve the desired final weight per unit area.

Accordingly, in a typical process the web may be longitudinally compressed in one or more stages to yield a batt which has a weight per unit area of 2.2 or 2.5 to 3.5 W and then decompressed by 0.3 to 0.5 W to give a final, unbonded batt, weight per unit area of 2 to 3 W. This longitudinal expansion stage relaxes internal strains within the batt and both improves the process and the product. If longitudinal decompression is not applied then it will generally be necessary to constrain the batt against buckling upwardly as it travels from the longitudinal compression stages to the curing oven and through the curing oven.

The longitudinal compression is applied by decelerating the web as it passes through a confined passage. Any longitudinal decompression can be applied by accelerating the web.

The invention is applicable to any type of mineral fibre but preferably it is applied to mineral fibres formed by centrifugal fiberisation of a mineral melt. The mineral fibres can be glass fibres. The fibres are preferably of the types generally known as rock, stone of slag fibres.

The fiberisation can be by a spinning cup process in which melt is centrifugally extruded through orifices in the walls of a rotating cup. Alternatively the fiberisation can be by centrifugal fiberisation off one fiberising rotor, or off a cascade of a plurality of fiberising rotors, which rotate about a substantially horizontal axis. The fiberisation of the fibres is usually promoted by airblasts around the or each rotor and the fibres are entrained by air and carried to a collector. Binder is sprayed on to the fibres before collection. Methods of this general type are well known and are particularly suitable for rock, stone or slag fibres. WO 96/38391 describes a preferred method of apparatus in detail and refers to extensive literature on fiberisation processes which can also be used for making the fibres.

The fibres can initially be collected on the collector as a primary web having the weight per unit area of W. Often, however, the fibres are initially collected as a primary web having a weight per unit area of, typically, 0.05 to 0.3 W and this primary web is then cross-lapped in conventional manner to form a secondary web having the desired weight per unit area W.

The longitudinal compression or other reorientation increases the Z direction component, and reduces the X direction component, of the fibres and of defects which are intermingled with the fibres in the web which is subjected to longitudinal orientation. Simple visual examination of a side of the batt cut along the X direction will usually show that the fibres have been reoriented to have an increased Z direction component compared to a normal airlaid product. In particular, visual examination will often show that the batt includes fibres which can be seen to be arranged as lamellae that extend predominantly in the Z direction in contrast to the normal predominantly XY configuration of airlaid products.

When the reorientation is by longitudinal compression, these lamellae may consist of whole pleats which extend substantially through most or all of the depth of the final product (for instance as shown in FIG. 2 of WO 97/36035) or the lamellae may be present more on a micro scale so that individual, Z direction lamellae can be seen but there is no overall macro pleating of the product. This type of arrangement can be achieved when the longitudinal compression is conducted in accordance with, for instance, WO 97/36035. Visual examination may also show the presence of defects, such as over-bonded aggregates of fibres, extending in the Z configuration.

Instead of or in addition to determining the presence of the increased Z direction component visually, it can be determined by ascertaining whether the bending strength (i.e., the resistance to being bent in the Z direction) of the cured batt, or the acoustic element, in a first direction in the XY plane is substantially greater than the bending strength in the second direction which is perpendicular to the first in the XY plane. In practice the direction of greatest bending strength will be along the Y direction (i.e., transverse to the machine direction) of the product as made, and the second direction will be the X (or machine) direction. The ratio of Y direction bending strength:X direction bending strength is preferably at least 2:1 and often at least 2.5:1. For products where the cut batt, and thus the thickness of the acoustic element, is relatively low, for instance less than 40 mm thick especially 15 to 30 mm thick, it is generally satisfactory for the ratio to be not more than about 4 or 5, and often not more than 3.5. However for some products, especially thicker products where the batt thickness in the acoustic element is thicker, for instance 50 to 100 mm, then it can be desirable or satisfactory for the ratio to be higher, for instance above 5:1 but usually not above 8:1 or 10:1.

The bending strength in the X or Y direction is determined by cutting 300 mm by 70 mm samples from the batt under test, with the 300 mm dimension extending in the Y direction for determining the bending strength in the Y direction and extending in the X direction for determining the bending strength in the X direction. Each sample is placed on a pair of supports separated by 200 mm and an increasing load is applied in the centre between the supports. This load moves at a speed of 20 mm per minute and the resulting force is measured continuously and the results are plotted. The maximum load per area (newtons per square meter) is the value just before the sample breaks. Typically the strength in the X direction is less than 0.1 or 0.15N/$m^2$, typically 0.05 to 0.1N/$m^2$, while the strength in the Y direction is typically above 0.2N/$m^2$, for instance between 0.2 and 0.3N/$m^2$.

As a result of cutting the cured batt in the XY plane into two cut batts and thereby forming the cut surface, and then abrading this surface, the arrangement of fibres in the cut face will visually be different from the arrangement of fibres in the uncut face. In the uncut face the fibres will be substantially undamaged and the outermost fibres at least will have a substantial XY direction component, as is conventional. This is due to the fibres in the face having been in contact with the belts or rolls which transport the web and the batt through the processing stages. In contrast, the fibres in the cut face can be seen by visual microscopic or naked eye inspection to have been damaged and abraded and the conventional outermost layer of fibres predominantly in the XY direction will be absent.

The cutting of the bonded batt can be conducted in conventional manner, for instance using a band saw or rotary saw having a suitably small tooth size, for instance resembling a conventional fine wood saw. The abrasion or grinding can be by abrasive belt or any other abrasive or grinding element. The abrasive particles on the belt can be relatively coarse and thus the abrasion can be similar to a conventional coarse wood abrader or grinder.

The element of the invention consists predominantly of the defined batt, since the batt is the component which is primarily responsible for the sound absorption properties. A non-woven or other textile is generally bonded to the rear face (usually by application before cutting the cured batt and often before curing the batt) and a non woven or other textile is usually bonded to the cut face after abrasion. Alternatively either or both faces may have some other surface finish, for instance a paint coating, or the rear face may be uncoated. The thickness of the bonded batt, and of the element, is usually in the range 15 to 40 mm, preferably 15-30 mm, but it can be thicker, for instance up to 50 or 60 mm.

It is necessary that the acoustic elements should have sufficient edge strength for the use for which they are intended. If the batt has a high density, for instance above 120, 140 or 150 kg/$m^3$, the edge strength may be sufficiently great when using conventional amounts of binder. However when using some suitable batt densities in the present invention, for instance 70 to 120 or 90 to 110 kg/$m^3$, together with conventional amounts of binder (for instance 1 to 5%, preferably 3 to 5%, by weight of the batt) the edge strength will usually be sufficient for handling purposes but may only be sufficient for supporting the weight of the element (if it is being suspended from a grid) if the batt of the element is relatively thick, for instance above 30 or 40 mm, typically up to 50 or 60 mm.

When it is desirable to increase the edge strength of elements of the invention, and especially of elements less than 40 mm thick, (especially 15 to 30 mm) and/or of density not more than 140 kg/$m^3$, it is preferred for the fibres in the front and rear half thicknesses of the element to be oriented such that the edge breaking strength (as defined below) of the rear half thickness of the element is substantially greater than the edge breaking strength of the front half thickness of the element. The edge breaking strength of each half is measured by determining the force that has to be applied to a side surface of a slot cut in the centre of the first edge of the element to break that half out of the plane of the element. Thus the rear of the element is optimised for improving the edge breaking strength of that half while the front half is optimised, as described above, for improving the flatness of the front surface after cutting and abrasion.

This difference in edge breaking strength may be achieved by arranging that the fibres of the element at and adjacent to the rear face have a greater orientation in the XY plane than the fibres at 20% of the thickness of the batt from the rear face, and than the fibres in the centre of the batt and than the fibres adjacent to the front face. This increased orientation adjacent to the rear face (eg. in the outermost 20% or the outermost 10% or the outermost 5% of the thickness of the batt in the element) is preferably achieved by subjecting the uncured batt having the final desired weight per unit area to vertical compression just before, and preferably as it enters, the curing oven.

In particular, the thickness of the batt at the end of the longitudinal compression (and any longitudinal decompression) stage is T and the thickness after the vertical compression is preferably 0.2 to 0.95 T. It is usually at least 0.3 or 0.4 and often 0.5 T but usually is not more than 0.7 or 0.8 T. Preferably the vertical compression is conducted over a short travel length, for instance at a substantial nip on entry to the curing oven. The vertical compression influences particularly the fibre orientation adjacent each outer surface of the batt.

After the cured batt is cut into two batts, each resultant batt has a cut front face and a rear face having increased (relative to the fibres in the centre of the batt thickness) XY orientation in the fibres adjacent to the rear face. The increase in the outermost 5%, 10% or 20% of the rear part will be particularly prominent in the X direction (i.e., in the machine direction during the vertical compression). It is preferred that the acoustic elements are cut from the batt in a manner such that the fibres adjacent the rear face (in the outermost 20%, 10% or 5% of the thickness) have an increased orientation that extends substantially perpendicular to a first side edge of the tile, and so this side edge preferably extends in the Y direction (i.e., transverse to the machine direction during manufacture of the batt).

A slot which has opposing side surfaces and an end surface may be cut along this first edge extending in the XY plane. The preferential orientation of the fibres in the X direction will result in the half of the element between the slot and the rear face having greater edge breaking strength than the front half. Often there is a slot of this type cut both in the first side edge and in a third side edge substantially parallel to the first. Generally the other edges are profiled according to the required design of the element.

It is known to reinforce the shaped edges of an acoustic element by applying additional binder, for instance as described in WO 02/060597. With known acoustic tiles or other elements minor deviations in the configuration of the slot are sufficiently small relative to the flatness of the front face that they do not cause any visible negative impact on the appearance of the overall ceiling or wall. However the elements of the invention can be so flat that even very minor deviations (e.g., of 100 μm) in the interconnection between the slot and the supporting grid can result in spoiling the overall appearance of the flat surface.

If the elements of the invention, when provided with edge slots in conventional manner, do not give the very flat interconnections that are required (for instance due to a rather low binder concentration and/or rather low final density and/or insufficient X direction orientation in the rear face), we have found that it is possible significantly to reduce the risk of such deviations, and therefore improve the appearance of an overall wall or ceiling of acoustic elements having slots of this type cut in the edges, by modifying the usual way of making edges and slots. The new method comprises forming the slot by cutting and then shaping in conventional manner and then strengthening the side surfaces of the slot by impregnating the batt around the side surfaces and the end surface of the slot with a liquid curable impregnant, smoothing the impregnated side surfaces and then curing the impregnant. This means minor distortions that are initially present in the side surfaces of the cut slot are eliminated by the smoothing and curing.

The impregnant should be applied in an amount sufficient for it to extend at least 0.5 mm into the batt from each side surface of the slot. In order to optimise the positioning of the element it is generally unnecessary for the impregnant to extend more than 2 mm and in practice, for fire safety reasons, it is generally preferred that the impregnant does not extend more than 1 mm into the batt.

The impregnant is preferably a fluid composition containing 3-20% curable binder and 40 to 80% by weight of a powdered filler based on total weight (or 5 to 30% binder and 60 to 95% filler based on solids). The filler is usually an inorganic powder and a variety of inert powders can be used but preferably it is a material such as limestone.

The preferred way of forming the slot and applying the impregnant involves cutting the slot in the edge of the acoustic element in conventional manner, optionally followed by abrasion of the side surfaces of the slot, and then ejecting the liquid impregnant from a nozzle which slides within and relative to the slot along the length of the slot and which distributes the impregnant substantially uniformly over the side surfaces of the slot as it slides through the slot, and then curing the impregnant. Although the nozzle may achieve satisfactorily uniform distribution, the method usually comprises the additional step of pressing the impregnant into the side surfaces around the slot, and smoothing the surfaces, by sliding or rotating through the slot, after the nozzle but before the curing, a wiping member which is shaped to be a substantially tight fit within the slot. For instance it can be a disk having a profile which makes a tight fit with the slot.

This method is applicable to all acoustic elements including those of the invention and other elements made by known techniques from mineral fibres (for instance as discussed in the introduction to the specification) or other elements made from foamed or other porous insulating material.

The invention is now described with reference to the accompanying drawings in which.

Figure 1:
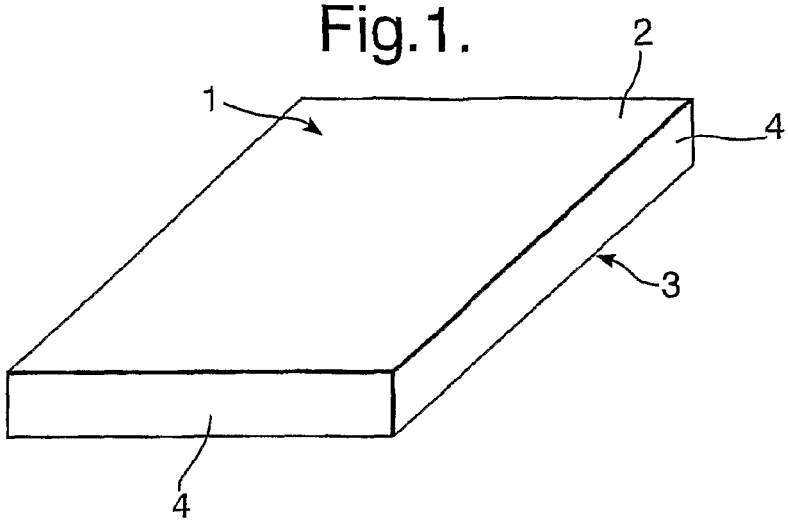
FIG. 1 is a perspective view of an acoustic element according to the invention.
Figure 4:
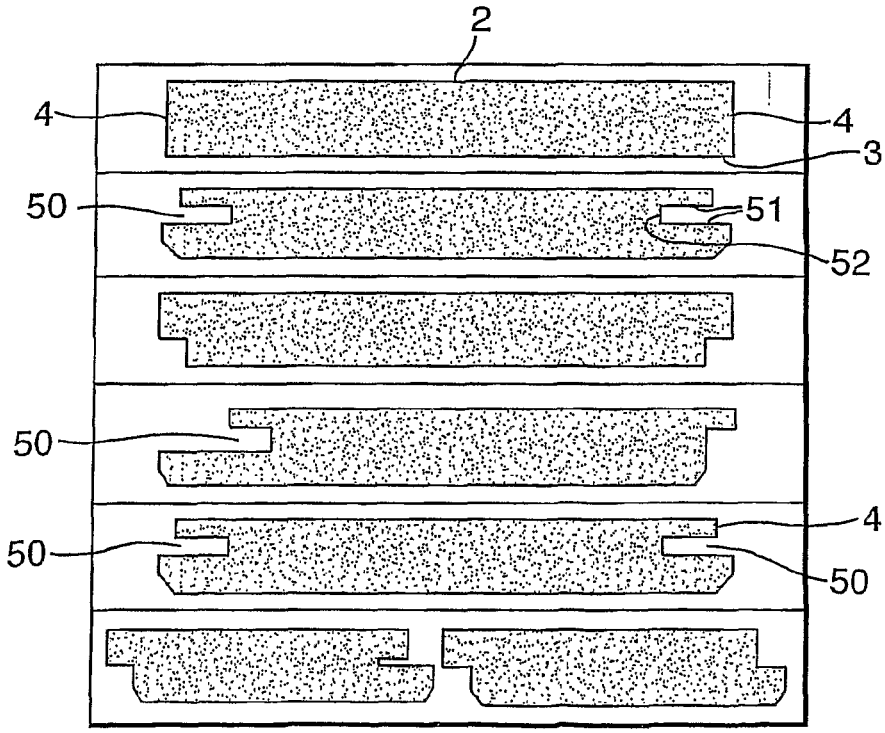
FIG. 4 are edge views of various shapes of elements according to the invention, showing the edge profiles of these

The acoustic element 1 of FIG. 1 has a smooth, flat, sound-absorbing front face 2 extending in what is referred to as the XY plane, a rear face 3 and side edges 4 extending in the Z direction between the front and rear faces. The element may consist solely of a bonded batt but usually it consists of a bonded batt together with a non-woven or other suitable textile covering on the front face 2 and also on the rear face 3. The side edges 4 may be square or may have some other profile, as shown in FIG. 4.

Figure 2:
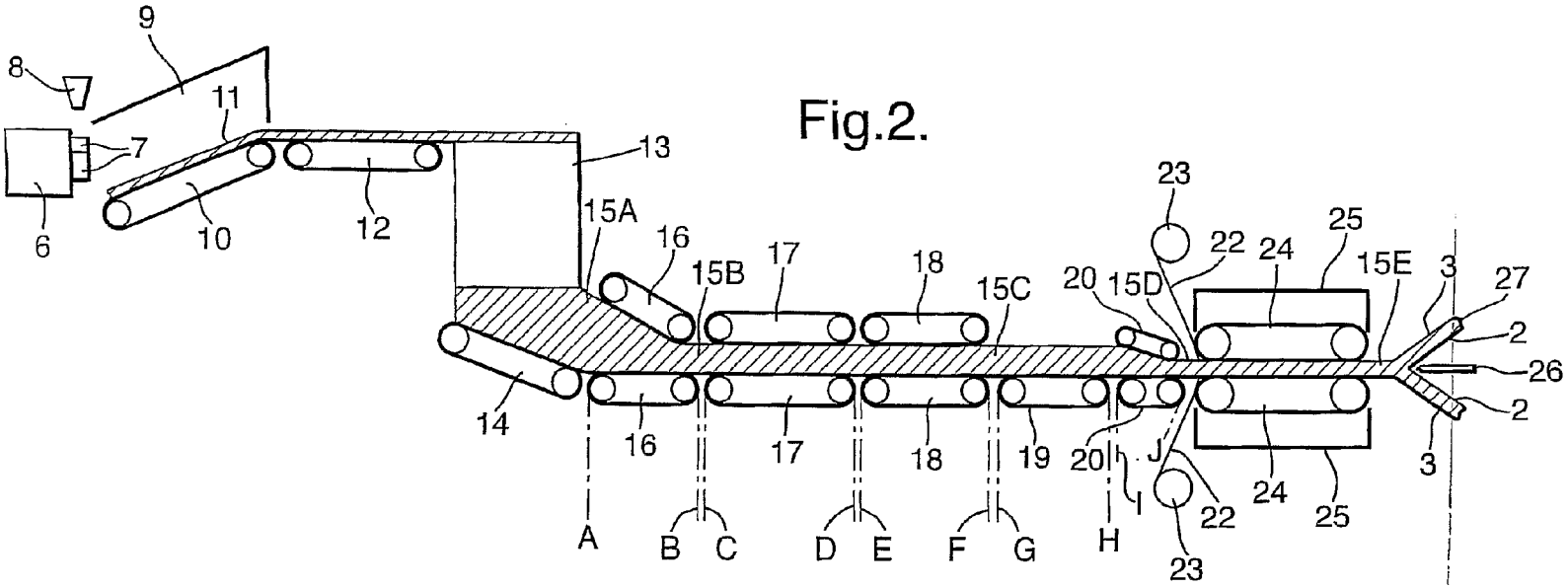
FIG. 2 is a diagrammatic illustration of one preferred process for the manufacture of such elements up to the curing oven stage.
Figure 3:
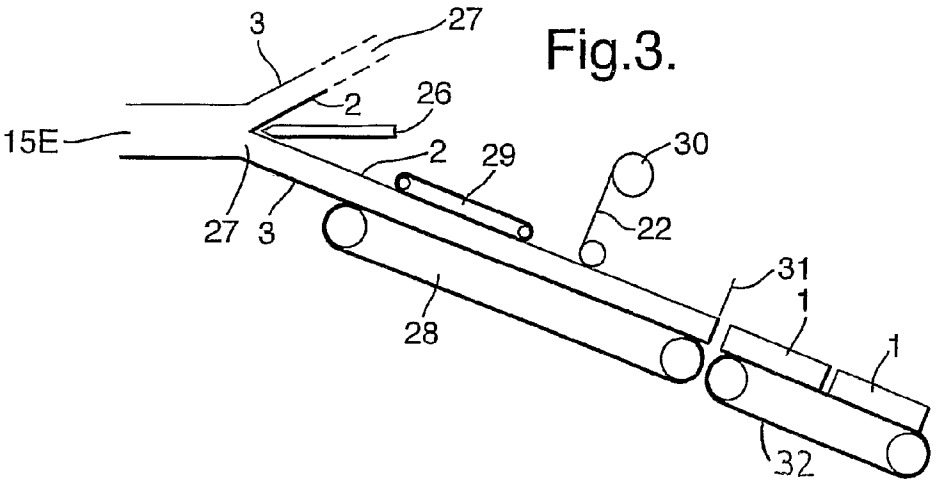
FIG. 3 is a diagrammatic continuation of FIG. 2 beyond the curing oven

As shown in FIG. 2, a typical apparatus for making the product comprises a cascade spinner 6 having a plurality of rotors 7 mounted on the front face positioned to receive melt from a melt gutter 8 whereby melt which falls on to the rotors is thrown from one rotor to the next and from the rotors as fibres. These fibres are entrained in air from in and around the rotors 7 whereby the fibres are carried forward into a collecting chamber 9 having a perforated collector conveyor 10 in its base. Air is sucked through the collector and a web 11 forms on the collector and is carried out of the collecting chamber 9 and on to another conveyor 12. The primary web 11 is led by conveyor 12 into the top of a cross-lapping pendulum 13 by which layers of the primary web are cross-lapped on one another as they are collected as a secondary web 15A beneath the pendulum on conveyor 14.

The secondary web 15A is led by conveyor 14 to a pair of conveyors 16 for applying vertical compression to the secondary web from its natural depth, at point A, to its compressed depth at point B. The secondary web at point A has a weight per unit area of W.

The compressed secondary web 15B is transferred from point C to point D by conveyors 17. Conveyors 16 and 17 usually all travel at substantially the same speed so as to establish a constant speed of travel of the secondary web from the vertical compression stage AB to point D.

The web is then transported between a pair of conveyors 18 which extend between points E and F. Conveyors 18 travel much more slowly than conveyors 16 and 17 so that longitudinal compression is applied between points D and F.

Although items 14, 16, 17 and 18 are shown for clarity as conveyor belts spaced apart from one another in the X direction, in practice they are normally very close to one another in the X direction.

Points D and E are preferably sufficiently close to one another or are interconnected by bands, to prevent the secondary web escaping from the desired line of travel. As a result, substantial longitudinal compression has occurred when the web emerges at point F. Restraining guides can be provided, if necessary, between D and E to prevent break out of the web if D and E are not close together.

The resultant longitudinally compressed batt 15C is then carried along conveyor 19 between points G and H at a higher speed than by the conveyors 18. This applies some longitudinal decompression or extension to the longitudinally compressed web and prevents the web breaking out from the desired line of travel and, for instance, buckling upwards due to internal forces within the web. If desired or necessary, a conveyor or other guide (not shown) may rest on the upper surface of the batt (above conveyor 19) so as to ensure that there is no breakout.

When vertical compression is to be applied to the longitudinally compressed web, this is done by passing the web, after it leaves point H, between conveyors 20, which converge so as to compress the web vertically as it travels between the conveyors and points I and J.

The resultant uncured batt 15D may then be contacted on each outer face by a textile non-woven or other supporting sheet material 22 from rolls 23, with binder to bond the textile to the batt. The resultant assembly then passes through a curing oven 25 where just sufficient pressure is applied by conveyors 24 to hold the sandwich of two layers of textile 22 and the batt 15D together while curing of the binder occurs. Alternatively the batt 15D may be cured by passage through the oven without the prior application of any textile.

The bonded batt 15E emerges from the curing oven and is sliced centrally by a band saw 26 or other suitable saw into two cut batts 27 each having an outer face 3 carrying the textile 22 and an inner cut face 2. Each cut batt 27 is supported on a conveyor 28 and travels beneath an abrading belt 29 where it is abraded or ground to a flat configuration, and a non-woven or other textile 22 is applied from roll 30 and bonded to the abraded surface 2. The abraded or ground cut batt 27 is then divided by appropriate cutters 31 into individual batts 1 which are carried away on conveyor 32. A textile may be bonded on to the rear face if it was not applied earlier. Paint may be applied to either or both faces.

Throughout this description, conveyor bands or belts are illustrated but any or all of the conveyors can be replaced by any suitable means of causing the relevant transport with acceleration, deceleration or vertical compression as required. For instance roller trains may be used instead of belts.

In typical processes, the primary web 11 which enters the cross lapper has a weight per unit area of 100 to 600 g/m$^2$, often 250 to 400 g/m$^2$.

The primary web is then typically cross lapped approximately four to fifteenfold, e.g., sixfold, to give a secondary web 15A of W=1.5 to 3, often around 2.2 to 2.8, kg/m$^2$. This secondary web 15A at point A typically has a density of 5 to 20, often 10 to 20 kg/m$^3$.

This uncompressed primary web 15A is then subjected to vertical compression between points A and B at a ratio which is often between 1.5 and 3. The compressed secondary web 15B at point B will then typically have a density in the range 10 or 20 to 50, often around 25 to 40, kg/m$^3$.

The speed of the conveyors 17 and of the lower conveyors 16 and 14, are usually approximately the same and result in the web 15B travelling at a speed which is usually at least 2 times, and often 2.5 to 3.5 times, the speed of conveyors 18. This results in the longitudinally compressed web 15C at point F having been longitudinally compressed in a ratio typically of 2.5:1 to 3.5:1, relative to the web 15B at point D.

The conveyor 19 travels slightly faster than the conveyors 18 so as to apply longitudinal decompression between points F and H. Typically the ratio of the speed of the conveyors 18 and the speed of the conveyor 19, and thus the ratio of longitudinal decompression, is in the range 0.7:1 to 0.98:1, preferably 0.75:1 to 0.95:1 and most preferably 0.8:1 to 0.9:1. As a result, the ultimate uncured batt 15D has been subjected to longitudinal compression (as indicated by the difference in speed of travel or the difference in density) between point C and points H, I and J which is generally in the range 2.0:1 to 3.0:1, preferably 2.2:1 to 2.8:1 and most preferably around 2.4 to 2.6:1.

Although the conveyors 20 may be omitted if vertical compression is not required, if vertical compression is being applied then the conveyors 20 are provided to give a decrease in thickness so that the batt is reduced in thickness from point H, where it is thickness T, to a thickness of 0.2 or 0.3 to 0.95 T, preferably 0.4 to 0.9 T, at point J, just before entry to the curing oven. This represents a vertical compression ratio of 5:1 to 1.05:1 (preferably 3.3:1 to 1.1:1 T), with the thickness often being 0.7 to 0.9 T, representing a ratio of 1.45:1 to 1.1:1.

EXAMPLE 1

Using the process illustrated in FIG. 2, a primary web 11 having a weight per unit area of 340 g/m$^2$ is formed on collector 10 and is cross lapped by pendulum 8 to form a secondary web 15A which is 5.6 layers thick and has a weight per unit area of 1.9 kg/m$^2$ and a density of 15 kg/m$^3$.

This is subjected to vertical compression by the conveyors 16 to increase the density to 32 kg/m$^3$ for the web 15B.

Conveyors 14, 16 and 17 all travel at about the same speed to cause the secondary web 15 to travel through the conveyors 17 at about 23 meters per minute.

Conveyors 18 travel at 7.8 meters per minute giving a longitudinal compression of about 2.9:1. The batt 15C at point F has a density of 88 kg/m$^3$.

Conveyor 19 travels at 9.2 meters per minute giving a decompression of 0.85:1, an overall longitudinal compression of 2.5:1 and a batt which at point H has a weight per unit area of 4.8 kg/m$^2$ and a density of 89 kg/m$^3$.

The thickness of the batt at point H is 130 mm and the vertical compression reduces it to 80 mm, thereby increase the density to 120 kg/m$^3$ for batts 15D and 15E in FIG. 2.

The thickness of the web is substantially constant from points B to I at 130 mm and the thickness of the batt after point J is substantially constant at 80 mm.

The cured batt 15E is 80 mm thick and is then split by the saw 26 and milled at 29 into two batts 27 each slightly less than 40 mm thick (due to loss of material during sawing) and milling. Conventional facing fleece 22 is applied to the front face to provide the final products.

The front face 2 of the final product had a flatness value of less than 2, and this is wholly satisfactory as a ceiling tile. It had an absorption coefficient of at least 0.9, and so is also satisfactory from this aspect.

EXAMPLE 2

A process is conducted broadly as described in Example 1 except that the relative speed of conveyor 18 relative to 14, 16 and 17 gives a decompression of 0.9 instead of 0.85 and the overall longitudinal compression is 2.0 instead of 2.5, the thickness at point H is 132 mm and the vertical compression reduces it to 47 mm, thereby increasing the density to 150 kg/m$^3$. After splitting and milling each batt has a thickness of about 21 mm, and fleece is then bonded onto each cut face.

EXAMPLE 3

In order to demonstrate the significance of varying the length compression, and thus varying the Z direction component of the fibres extending from the front face, a process substantially as Example 1 was carried out with a thinner product, so that the thickness of the batt 15D going through the curing oven was 40 mm and the thickness of the batt 15C, before the vertical compression, was 60 mm and with various amounts of longitudinal compression. It was found that when the overall longitudinal compression was 1.6:1 the flatness value was 2.05 (standard deviation 0.27). This is not as flat as is desirable. When the longitudinal compression was 2:1 the flatness value was 1.59 (standard deviation 0.2) and when the longitudinal compression was 2.5:1 the flatness value was 1.55 (standard deviation 0.15). This clearly shows the benefit of having the longitudinal compression significantly greater than 1.6:1 and preferably at least 2:1, thereby increasing the Z direction component adjacent to the front face.

Having made the basic element (for instance as shown in FIG. 1 by a process as in Example 1) the edges can be profiled by milling, and slots cut into any of the edge profiles and slot configurations, as shown in FIG. 4. The edges can be impregnated and thereby strengthened as shown in WO02/060597.

As shown in FIG. 4, slots 50 may be formed in one side edge or in an opposing pair of side edges. The slots have side surfaces 51 and end surfaces 52. As is apparent, the side surfaces extend substantially in the XY plane. In order to strengthen the surfaces of the elements and so as to ensure that they are smooth and accurately configured, they are impregnated with an appropriate impregnant.

Figure 5:
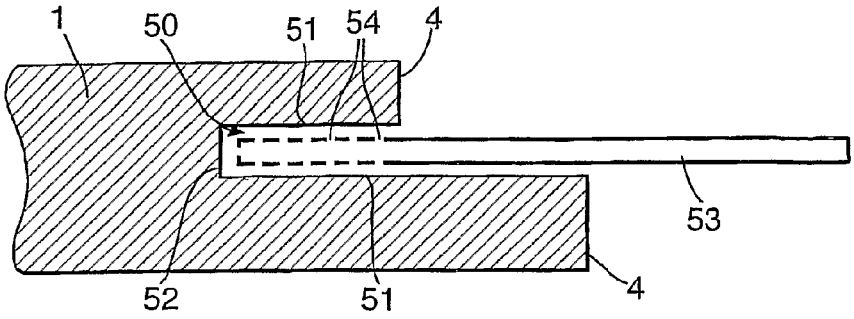
FIGS. 5, 6 and 7 are partial cross sections of tiles during the process of impregnating grooves cut in their edges.

As shown in FIG. 5, this impregnation can be achieved by, for instance, sliding an impregnating nozzle 53 having nozzle outlets 54 through the slot, for instance by sliding the element 1 past the slot. The nozzle outlets 54 may be arranged around a cylindrical tube or they may be in a fan-shaped or other flat arrangement. The individual outlets 54 can themselves be shaped outlets and can point in any suitable direction. The objective is to achieve as uniform distribution as possible of impregnant over the surfaces 51, and preferably also 52.

Figure 6:
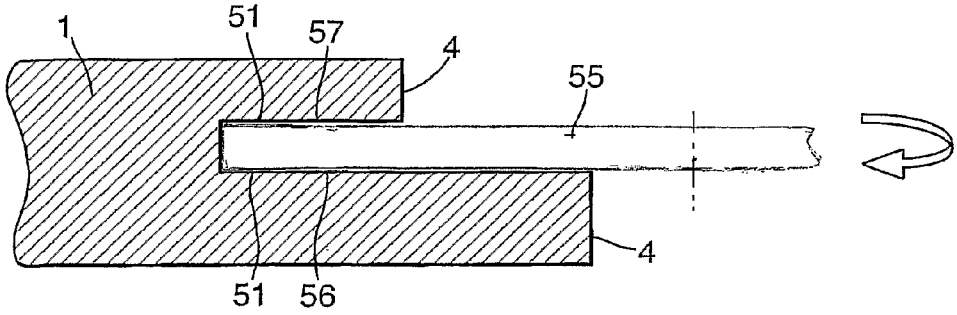

It is then desirable to press the impregnant into the side surfaces 51 and preferably also the end surface 52 by sliding a wiping member through the slot while the impregnant remains uncured. As shown in FIG. 6, this wiping member can be a rotating wheel 55 having upper and lower surfaces 56 and 57 that make a tight sliding fit with the surfaces 51 of the slot.

Figure 7:
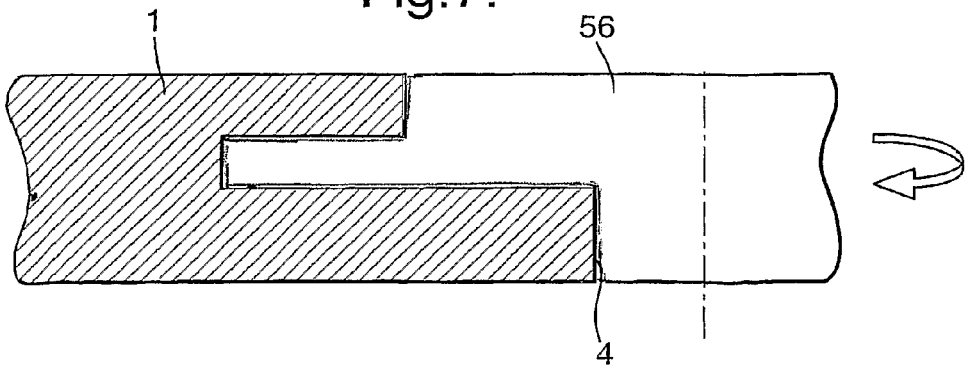

Although the parts of the side edges 4 above and below the slot can be reinforced separately, it is convenient to apply the same impregnant to these, for instance by spraying or by the use of wheels which are appropriately configured. Conveniently all faces are then subjected to an appropriate wiping process in order to ensure uniform impregnation and smoothness of the faces. Accordingly, instead of merely wiping the impregnant into the faces of the slot, as shown in FIG. 6, the impregnant can conveniently be pressed into all the faces using an appropriately shaped wheel 56, as shown in FIG. 7. The following is an example of this method.

EXAMPLE 4

A typical impregnant for reinforcing the slot, and optionally also the other faces of the edges, has the composition

| | |
|---|---|
| Binder, e.g., styrene acrylate | 6-14 parts |
| Filler, e.g., limestone powder | 55-75 parts |
| Dispersion agent | <0.5 parts |
| Foam moderator | <0.5 parts |
| Rheology modifier, e.g., urethane based | <0.5 parts |
| Film intensifier, e.g., melamine based | 1-5 parts |
| Water | 18-30 parts |
| | 100 parts |

Typically it is applied in an amount of from 1 to 1.2 kg/m$^2$ of surface which is being impregnated and typically the impregnant will penetrate 1 mm into each surface.

The element is then subjected to appropriate conditions to cure the binder.

Another suitable method for providing edge slots in elements of the invention, especially those having higher densities (such as 120-200 kg/m$^3$) and/or high amounts of bonding agent comprises grinding and/or milling the edges to the desired profile of each edge but in the absence of the slots, then impregnating the edges by liquid curable impregnant, curing the impregnant, forming the slots by grinding and/or milling into the edges, and sealing the exposed surfaces by a paint.

The following is an example of this method.

EXAMPLE 5

An element made according to Example 2 has its edges (free of slots or grooves) formed by grinding or milling. The resultant edges are then impregnated with the curable impregnant used in Example 4. After curing, the required grooves or slots are ground or milled into the edges in conventional manner. The resultant edges may then be painted with a curable white paint, for instance having the composition

| | |
|---|---|
| Binder, e.g., styrene acrylate | 6-14 parts |
| Pigment, e.g., titaniumdioxide | 4-8 parts |
| Filler, e.g., carbonates | 55-70 parts |
| Dispersing agent | <1 parts |
| Defoamer | <0.5 parts |
| Rheology modifier | <0.5 parts |
| Film expander | 2-4 parts |
| Preserving agent | <0.2 parts |
| Water | 15-30 parts |
| | 100 parts |

The invention claimed is:

1. An acoustic element panel adapted to be a visible element of a wall or ceiling having a flat, sound-receiving, front face which extends in the XY plane and which has a sound absorption coefficient of at least 0.7, a rear face substantially parallel to the front face, and side edges which extend in the Z direction between the front face and rear faces, and in which the element consist predominantly of a bonded batt of airlaid mineral fibres, characterised in that the bonded batt has a density of 70 to 200 kg/m$^3$, the fibres extending from the front face and at least through the front half of the thickness of the batt have a Z direction component substantially greater than the Z direction component of fibres in airlaid products made by collecting fibres entrained in air by suction through a travelling collector and vertically compressing the collected fibres, optionally after cross-lapping the collected fibres, and the front face of the bonded batt is a cut and abraded face.

2. A panel according to claim 1 in which visual examination shows that the fibres include lamellae and the lamellae extend substantially in the Z direction from the cut surface.

3. A panel according to claim 1 in which the ratio of the bending strength (the resistance to being bent in the Z direction) of the batt in a first direction in the XY plane to the bending strength of the batt in a second direction, perpendicular to the first direction, in the XY plane is at least 2 when determined as defined herein.

4. A panel according to claim 1 in which the Z direction component of the fibres is the component achievable by a process comprising collecting the fibres on a travelling collector as a web, optionally cross-lapping the web, vertically compressing the resultant web to a density of at least 10 $kg/m^3$, and then longitudinally compressing the web in a ratio of at least 1.7:1, under conditions of uniform thickness.

5. An element according to claim 4 in which the Z direction component of the fibres is the component achievable by a process comprising collecting the fibres on a travelling collector as a web, optionally cross-lapping the web, vertically compressing the resultant web to a density of at least 10 $kg/m^3$, and then longitudinally compressing the web in a ratio of at least 12:1 under conditions of uniform thickness.

6. A wall or ceiling comprising a plurality of elements according to claim 1 in which the front faces of the elements are arranged so as to be visible and another edge or face is mounted to a support.

7. A panel according to claim 1 in which the mineral fibres are rock, stone or slag.

8. A panel according to 1 in which the fibres of the element at and adjacent the rear face have a greater orientation in the XY plane than the fibres at a distance from the rear face which is 20% of the thickness of the batt.

9. A panel according to claim 1 in which the fibres adjacent the rear face have an orientation that extends predominantly in the XY plane substantially perpendicular to a first side edge of the tile, and there is a slot cut along this first edge and extending in the XY plane and which has opposing side surfaces and an end surface.

10. A panel according to claim 1 in which there is a slot which has opposing side surfaces and an end surface and which is cut along at least a first side edge of the element and extends in the XY plane, and impregnant extends 0.5 to 2 mm into the batt from both side surfaces of the slot.

11. A panel according to claim 10 in which there is a similar slot in a third side edge substantially parallel to the first side edge.

12. A panel according to claim 1 in which the density of the batt in the element is 70 to 140 $kg/m^3$.

13. A panel according to claim 1 having a facing web on the front face and optionally on the rear face of the batt.

14. A method of makings panels according to claim 1 comprising collecting mineral fibres and binder entrained in air on a travelling collector and vertically compressing the collected fibres, optionally after cross-lapping, to form a web reorienting the fibres to provide an unbonded batt having a density of 70to 200 $kg/m^3$ and an increased fibre orientation in the Z direction, curing the binder to form a cured batt, cutting the cured batt in the XY plane into two cut batts at a position in the Z dimension where the fibres have the increased orientation in the Z direction, and smoothing each cut surface by abrasion to produce a flat face.

15. A method according to claim 14 in which the reorientation of the fibres is achieved by vertically compressing the web to a density of at least 10 $kg/m^3$ and a weight per unit area of W, and subjecting the web to longitudinal compression whereby the unbonded batt which is subjected to curing has a weight per unit area of at least 2 W.

16. A method according to claim 15 in which the unbonded batt has a weight per unit area of 2.3 to 3 W.

17. A method according to claim 16 in which the web having a weight per unit area of W is subjected to longitudinal compression and then longitudinal decompression to reduce the weight per unit area by 0.2 W to 1 W and to produce the weight per unit area in the unbonded batt of at least 2 W.

18. A method according to any of claim 15 in which the batt formed by the longitudinal compression has a thickness T and the batt is subjected to vertical compression to a final thickness of 0.2 to 0.95 T prior to curing.

19. A method according to claim 14 comprising the additional step of cutting along at least one of the side edges a slot which extends in the XY plane and which has opposing side surfaces, ejecting liquid, curable, impregnant from a nozzle which slides within and relative to the slot along the length of the slots, pressing the impregnant into the side surfaces by sliding or rotating through the slot a wiping member which is shaped to be a substantially tight fit with the slot, and then curing the impregnant.

20. A method according to any of claim 18 in which the batt is subjected to vertical compression to a final thickness of 0.4 to 0.95 T prior to curing.

21. A method according to claim 17 in which the web having a weight per unit area of W is subjected to longitudinal compression and then longitudinal decompression to reduce the weight per unit area by 0.2 W to 1 W and to produce the weight per unit area in the unbonded batt of 2.3 to 3 W.

* * * * *